US007760217B1

(12) United States Patent
Fotland et al.

(10) Patent No.: US 7,760,217 B1
(45) Date of Patent: Jul. 20, 2010

(54) IMAGING METHODS AND IMAGING DEVICES

(75) Inventors: Richard A. Fotland, Franklin, MA (US); Robert A. Moore, Mashpee, MA (US); Napoleon Leoni, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1090 days.

(21) Appl. No.: 11/413,822

(22) Filed: Apr. 28, 2006

(51) Int. Cl.
*B41J 2/385* (2006.01)

(52) U.S. Cl. ..... 347/140

(58) Field of Classification Search ..... 347/55, 347/125, 155, 140, 141, 151, 228, 224; 399/233, 399/237, 296, 249–250; 101/450.1, 470
See application file for complete search history.

(56) References Cited

U.S. PATENT DOCUMENTS

| | | | | |
|---|---|---|---|---|
| 3,892,645 | A | 7/1975 | Castegnier | |
| 4,266,869 | A | 5/1981 | Kuehnle | |
| 4,379,969 | A | 4/1983 | Cobb et al. | |
| 4,402,000 | A | 8/1983 | Fabel et al. | |
| 4,553,149 | A | 11/1985 | Yano | |
| 4,590,496 | A | 5/1986 | Toyono et al. | |
| 4,635,074 | A | 1/1987 | Young | |
| 4,734,722 | A | 3/1988 | Maczuszenko et al. | |
| 4,895,629 | A | 1/1990 | Castegnier et al. | |
| 5,406,359 | A | 4/1995 | Fletcher | |
| 5,510,817 | A | 4/1996 | Sohn | |
| 5,538,601 | A | 7/1996 | Castegnier | |
| 5,581,290 | A | 12/1996 | Kuehnle | |
| 5,826,147 | A | 10/1998 | Liu et al. | |
| 5,835,826 | A | 11/1998 | Okada et al. | |
| 5,966,570 | A | 10/1999 | Till et al. | |
| 6,006,061 | A * | 12/1999 | Liu et al. | 399/296 |
| 6,090,257 | A | 7/2000 | Castegnier et al. | |
| 6,113,231 | A | 9/2000 | Burr et al. | |
| 6,134,409 | A | 10/2000 | Staples et al. | |
| 6,152,037 | A | 11/2000 | Ishii et al. | |
| 6,193,366 | B1 | 2/2001 | Thomas, Jr. et al. | |
| 6,210,553 | B1 | 4/2001 | Castegnier et al. | |
| 6,219,501 | B1 | 4/2001 | Zhao et al. | |
| 6,221,138 | B1 | 4/2001 | Kenny | |
| 6,253,051 | B1 | 6/2001 | Iikura et al. | |
| 6,283,029 | B1 | 9/2001 | Tashiro et al. | |
| 6,298,780 | B1 | 10/2001 | Ben-Horin et al. | |
| 6,347,210 | B1 | 2/2002 | Fotland | |
| 6,363,234 | B2 | 3/2002 | Landa et al. | |
| 6,428,160 | B2 | 8/2002 | Roy et al. | |
| 6,536,876 | B1 | 3/2003 | Fotland et al. | |
| 6,982,735 | B2 * | 1/2006 | Moore et al. | 347/125 |
| 2003/0190539 | A1 | 10/2003 | Niimi | |

OTHER PUBLICATIONS

Castegnier, "Electroagulation: A Novel Contone HighSpeed Dynamic Digital Printing Technology"; Elcorsy Techonolgy, Inc; Dec. 11, 2000; pp. 608-621.

Ito et al.; "Electrostatic Powder Transfer Technology (EPT)- A Simple Powder Imaging Process"; S & T 7th Int. Congress on Advances in Non-Impact Printing Technologies, vol. 2, 1991; p. 519.

* cited by examiner

*Primary Examiner*—Hai C Pham

(57) ABSTRACT

Imaging methods and imaging devices are described according to some aspects. According to one aspect, an imaging method includes defining a plurality of first portions of a layer of a marking agent corresponding to an image to be formed, removing the second portions of the marking agent after the defining, increasing a charge density of the first portions of the marking agent after the removing, and transferring the first portions of the marking agent after the increasing.

22 Claims, 2 Drawing Sheets

IMAGING METHODS AND IMAGING DEVICES

FIELD OF THE DISCLOSURE

Some aspects of the disclosure relate to imaging methods and imaging devices.

BACKGROUND

Imaging devices and methods for forming hard copy images upon media continue to adapt and improve as consumer demands increase for arrangements with increased imaging speeds or imaging quality. Improvements may be made in existing imaging technologies and new imaging technologies have also been developed to meet these demands.

Some imaging methods use various types of long-run print forms, such as gravure signatures, offset plates, or flexographic belts, which may carry a recorded representation of a desired image. Other imaging methods implement marking methods without the use of printing forms. Exemplary marking imaging methods include various types of ink jet imaging. Electrostatic imaging methods are also used in imaging applications such as laser imaging and may include steps of discharging portions of an electrically charged dielectric member to form images.

The various imaging methods may have different respective advantages which may be preferred for use in different imaging applications, including for example, high print quality reproduction applications, high imaging speed applications, and color reproduction applications.

SUMMARY

According to some aspects of the disclosure, exemplary imaging methods and imaging devices are described.

According to one embodiment, an imaging method includes defining a plurality of first portions of a layer of a marking agent corresponding to an image to be formed, removing the second portions of the marking agent after the defining, increasing a charge density of the first portions of the marking agent after the removing, and transferring the first portions of the marking agent after the increasing.

According to another embodiment, an imaging device comprises a supply device configured to supply a marking agent to be used to form hard images; an imaging member configured to support the marking agent; an image head configured to define a plurality of first portions of the marking agent corresponding to an image to be formed; a development assembly configured to remove second portions of the marking agent from the imaging member; and a charge device configured to provide an electrical charge to the first portions of the marking agent after the removal of the second portions of the marking agent and prior to transfer of the first portions of the marking agent from the image member.

Other embodiments are described in the disclosure.

DETAILED DESCRIPTION

At least some aspects of the disclosure pertain to imaging methods and imaging devices for generating hard copy images upon media (e.g., printing images upon paper). Details regarding exemplary imaging which may be implemented according to one embodiment are described in a digital lithographic process of U.S. Pat. No. 6,536,876, the teachings of which are incorporated herein by reference. For example, as discussed below, imaging may include defining selected portions of a liquid marking agent corresponding to an image and transferring the portions to media. According to some embodiments of the present disclosure discussed below, the portions of the marking agent corresponding to an image receive an electrical charge prior to transfer of the images to media. Other aspects and embodiments are discussed below.

Figure 1:
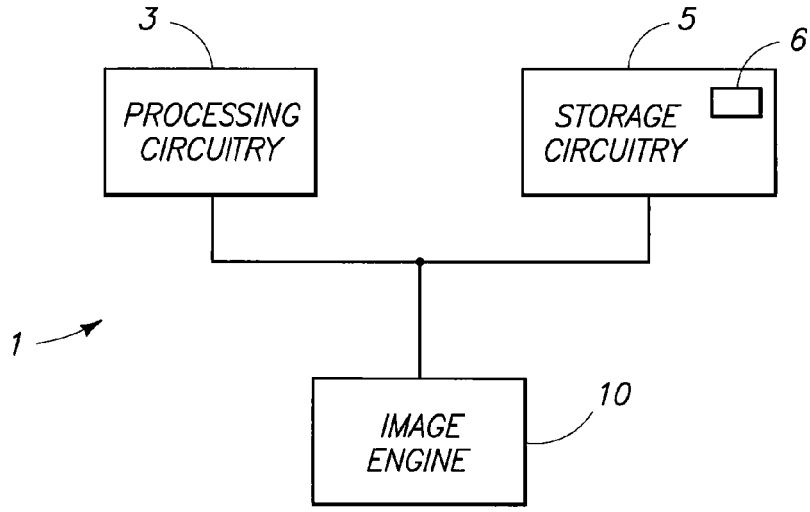
FIG. 1 is a functional block diagram of an imaging device according to one embodiment.

Referring to FIG. 1, an illustrative representation of an imaging device 1 is depicted. In one embodiment, the imaging device 1 may be configured as a digital imaging device configured to access digital image data for use in forming hard copy images upon media, such as paper, labels, transparencies, etc. Exemplary arrangements of imaging device 1 include printers and copiers.

Imaging device 1 includes processing circuitry 3, storage circuitry 5, and an image engine 10 in the depicted exemplary configuration of FIG. 1. Other configurations of imaging device 1 are possible in other embodiments including more, less or alternative components.

In one embodiment, processing circuitry 3 is arranged to process data (e.g., access and process digital image data corresponding to a color, black and white, or grey scale image to be hard imaged upon media), control data access and storage, issue commands, monitor imaging operations and control imaging operations of imaging device 1. Processing circuitry 3 may comprise circuitry configured to implement desired programming provided by appropriate media in at least one embodiment. For example, the processing circuitry 3 may be implemented as one or more of a processor and/or other structure configured to execute executable instructions including, for example, software and/or firmware instructions, and/or hardware circuitry. Exemplary embodiments of processing circuitry 3 include hardware logic, PGA, FPGA, ASIC, state machines, and/or other structures alone or in combination with a processor. These examples of processing circuitry 3 are for illustration and other configurations are possible.

The storage circuitry 5 is configured to store programming such as executable code or instructions (e.g., software and/or firmware), electronic data (e.g., image data), databases, look up tables, or other digital information and may include processor-usable media. Processor-usable media includes any computer program product or article of manufacture 6 which can contain, store, or maintain programming, data and/or digital information for use by or in connection with an instruction execution system including processing circuitry in the exemplary embodiment. For example, exemplary processor-usable media may include any one of physical media such as electronic, magnetic, optical, electromagnetic, infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information.

At least some embodiments or aspects described herein may be implemented using programming stored within appropriate storage circuitry 5 described above and/or communicated via a network or using other transmission media and configured to control appropriate processing circuitry 3. For example, programming may be provided via appropriate media including for example articles of manufacture 6, embodied within a data signal (e.g., modulated carrier wave, data packets, digital representations, etc.) communicated via an appropriate transmission medium, such as a communications network (e.g., the Internet and/or a private network), wired electrical connection, optical connection and/or electromagnetic energy, for example, via a communications interface (not shown), or provided using other appropriate communication structure or medium. Exemplary programming including processor-usable code may be communicated as a data signal embodied in a carrier wave in but one example.

Image engine 10 is configured to implement a digital lithographic process in one possible embodiment. A liquid marking agent may be used to form images in one embodiment. Exemplary details regarding usage of a liquid marking agent according to one embodiment are discussed in the '876 patent where a liquid marking agent in the form of an ink layer is disclosed. The ink layer may have an electrorheological liquid composition including an electrically insulative carrier liquid containing a plurality of ink particles which may comprise colorant particles. The image engine 10 may provide an insulating ink layer coating upon an electrically conductive supporting member in one arrangement. Selected portions of the ink layer may be defined and developed which correspond to an image to be formed. As discussed below and in the '876 patent, portions of the ink layer to be developed are stiffened (i.e., viscosity is increased) compared with other portions of the ink layer not to be developed in one embodiment. Other marking agents may be used in other embodiments and other configurations of image engine 10 are possible.

Figure 2:
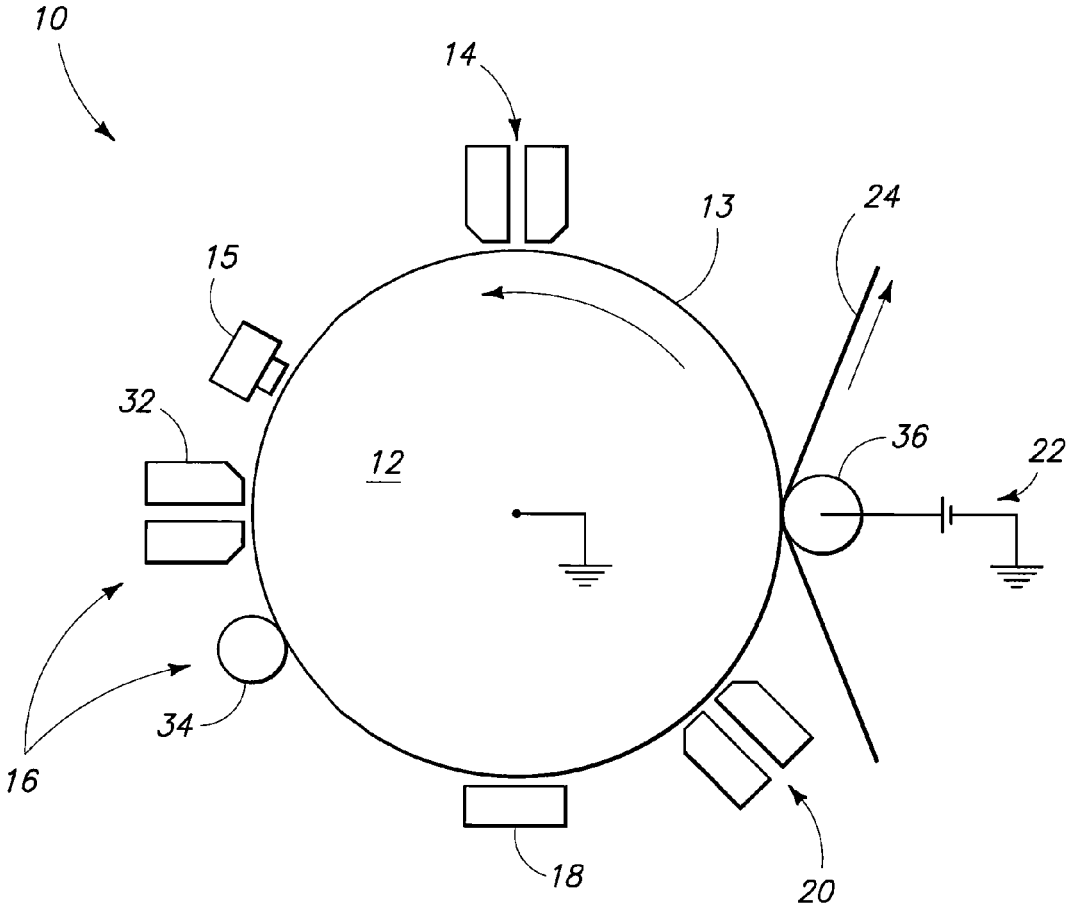
FIG. 2 is a functional block diagram of an image engine according to one embodiment.

Referring to FIG. 2, additional details of an exemplary image engine 10 are described in one possible implementation. In FIG. 2, image engine 10 includes an imaging member 12, a marking agent supply device 14, an image head 15, a development assembly 16, a charge device 18, a removal device 20 and a transfer assembly 22. Other configurations of image engine 10 including more, less or alternative components are possible in other arrangements.

Imaging member 12 may be a drum having an imaging substrate comprising an outer support surface 13 in one embodiment. Images may be formed and developed upon support surface 13 prior to transfer to media. An axis of imaging member 12 may be electrically grounded in one implementation. As discussed further below, at least a portion of imaging member 12 may be electrically conductive in exemplary arrangements. For example, in the described embodiment, support surface 13 is electrically conductive. In one embodiment, imaging member 12 may comprise an electrically conductive metal drum although other configurations are possible.

Supply device 14 is arranged to provide the marking agent to imaging member 12. In the described exemplary embodiment using a liquid marking agent, supply device 14 may be configured as a slot die to provide a layer of the marking agent upon support surface 13. The layer of marking agent may include colorant particles suspended in an electrically insulative fluid carrier in one embodiment. In one embodiment, a layer of marking agent is provided upon support surface 13 and has a thickness in a range of between about 2 microns to 20 microns (e.g., preferably about 8 microns in one arrangement) and a solids concentration between 5% and 30% (e.g., preferably about 20% in one arrangement).

Image head 15 may be implemented as a charge emitting print head electrically addressed (or controlled) to charge some portions of the layer of marking agent (e.g., portions selected by processing circuitry 3 corresponding to images to be generated) and to leave other portions of the layer of marking agent unexposed (e.g., corresponding to background areas) in one embodiment. Processing circuitry 3 may control charge exposure operations of image head 15 using image data of an image to be generated in one example.

In one embodiment, image head 15 is arranged to electrically charge selected portions of the marking agent to define images. The electrical charging by image head 15 forms a latent image in the described implementation. For example, in one arrangement, image head 15 provides an electrical charge to the portions of the marking agent having a negative charge density of 30 $nC/cm^2$ in one possible embodiment. Image head 15 may provide a positive electrical charge in other embodiments. The viscosity of the portions of the layer of the marking agent exposed to the electrical charge is increased by the electrical charge compared with the portions not receiving the electrical charge. As set forth in the incorporated '876 patent, the exposed portions of the marking agent are stiffened by the electrical charge. The charging by image head 15 may be referred to as an image-wise charge in one embodiment. In at least one embodiment, exposed portions of the marking agent may be referred to as first portions and correspond to images to be formed and unexposed portions of the marking agent may be referred to as second portions and correspond to background areas.

Development assembly 16 is located adjacent support surface 13 and is configured to develop images using the layer of marking agent upon support surface 13 and after the image-wise exposure by image head 15. In the illustrated exemplary configuration, development assembly 16 includes an applicator 32 and a removal device 34.

In one example, following exposure of the portions of the layer of the marking agent corresponding to an image to be formed, the unexposed portions of the marking agent corresponding to the background areas may be removed from the support surface 13 during development by assembly 16. In one embodiment, applicator 32 is arranged to provide a development fluid to the support surface 13 having the exposed and unexposed portions of marking agent thereon. The development fluid operates to detach and flush away the unexposed portions of the marking agent from the surface 13 leaving the exposed portions of the marking agent corresponding to the image to be formed upon support surface 13. An exemplary development fluid is electrically insulative and is Isopar™, an aliphatic hydrocarbon fluid available from ExxonMobil Corporation in one embodiment. The development fluid develops the image by cleaning the marking agent from the uncharged areas of support surface 13 not corresponding to the latent image in the described embodiment.

Removal device 34 operates to remove the development fluid from the support surface 13. In one embodiment, the removal device 34 is implemented as a reverse roller configured to remove the development fluid. In some imaging applications, removal device 34 may remove some of the development fluid while leaving another portion of the development fluid upon support surface 13 which may negatively impact subsequent imaging operations and image quality. For example, an excess amount of development fluid remaining upon support surface 13 may distort transferred images due to lateral flow of the development fluid in a transfer nip during an exemplary subsequent transfer operation.

In one embodiment discussed below, an additional removal step may be implemented to remove development fluid remaining upon support surface 13 after development by assembly 16. In one configuration, a charge device 18 is placed adjacent to support surface 13 of imaging member 12 to provide an additional electrical charge to the developed portions of the marking agent over support surface 13. In one embodiment, charge device 18 provides a blanket electrical charge across substantially an entirety of an axial length of the imaging member 12 including both developed marking agent and background image areas. The provision of the additional electrical charge may maintain image quality during subsequent imaging operations as discussed below.

In one example, charge device 18 is configured to deposit a charge of the same polarity as the charge provided by image head 15 (e.g., deposit an electrical charge in a range of negative 10 to 1000 $nC/cm^2$ in one example and negative 85 to negative 100 $nC/cm^2$ in a more specific example). Charge device 18 may be implemented as one or more negative DC corona in one embodiment. In another embodiment, charge device 18 may be implemented as a high current density charging device. Details regarding exemplary configurations of charge device 18 are described in U.S. Pat. No. 4,379,969, U.S. Pat. No. 4,734,722, U.S. Pat. No. 5,406,359 and U.S. Patent Application Publication No. 2003/0190539, the teachings of which are incorporated herein by reference.

An initial attraction force (e.g., electrostatic force) is developed between the exposed portions of the marking agent and support surface 13 after exposure by image head 15 in one embodiment. The initial attraction force attracts the exposed portions to support surface 13. The application of the electrical charge by charge device 18 operates to increase the attraction force between the exposed portions of the marking agent (i.e., corresponding to the developed portions after development by assembly 16) and support surface 13. In one embodiment, a voltage of charge device 18 may be biased as to increase the charge density of developed portions of the marking agent. The charge provided by charge device 18 operates in the described arrangement to clamp the developed image to the support surface 13 which enables the utilization of the subsequent imaging operations described below without significant image degradation, such as distortion or smearing.

In the described embodiment employing an electrically conductive support surface 13, increased charge densities may be deposited compared with other imaging processes. For example, the developed portions of the described embodiment have a reduced potential compared with potentials which would result from the charging in other imaging arrangements such as electrophotographic processes which may use a photoconductive drum (e.g., an image voltage of 100 V for an image thickness of <4 microns in the described embodiment compared with image voltages of >550 V using a 15 micron photoconductor and higher than a minimum breakdown voltage in the Paschen curve). Background areas of the images remain at ground with the usage of an electrically conductive support surface 13.

As mentioned above, the charging provided by charge device 18 enables subsequent image processing steps which may otherwise degrade image quality. The increased charge density provided by device 18 increases the resistance of a developed image to shear stresses during subsequent processing such as drying or image transfer. In one embodiment, the electrical charge provided by charge device 18 increases the image stiffness (i.e., increases the viscosity if a liquid marking agent is used) and increases the shear strength of a developed image. In addition, the transfer of a developed image having increased charge densities may be enhanced when electrostatic transfer techniques are used.

Following charging by charge device 18, the developed portions of the marking agent corresponding to the developed image are processed by removal device 20 which is configured to remove additional development fluid from support surface 13 in a pretransfer processing step. Removal device 20 may be configured as a dryer and may create a flow of air over support surface 13 to remove remaining development fluid from support surface 13 which may otherwise degrade the resultant image generated by imaging device 1 if left upon support surface 13. In one arrangement, removal device 20 is configured as an air knife configured to provide the flow of air. In another embodiment, removal device 20 may be configured as a vacuum head or other suction device configured to remove the development fluid. Increased air flow velocities, such as 30 meters per second over surface 13, provided by removal device 20 may be used without distortion of a developed image compared with imaging arrangements which do not clamp images prior to exposure to removal device 20. In yet additional configurations, removal device 20 may be implemented as a heater to evaporate the development fluid upon support surface 13 of imaging member 12 or as a reverse roller to shear away excess development fluid.

Transfer assembly 22 is arranged to directly transfer the stiffened marking agent corresponding to the developed image to media 24 in the depicted example. In another embodiment, stiffened images may be transferred by transfer assembly 22 to an offset transfer roller (not shown) prior to application to media. Transfer assembly 22 may be configured to implement electrostatic transfer operations for example by using an electrical field to attract the marking agent of a developed image from imaging member 12 to media 24. For example, a roller 36 of transfer assembly 22 may be biased at approximately +1 kV to attract the negatively charged marking agent of the developed image in one embodiment. In other arrangements, transfer assembly 22 may be configured to implement pressure transfer of developed images.

Figure 3:
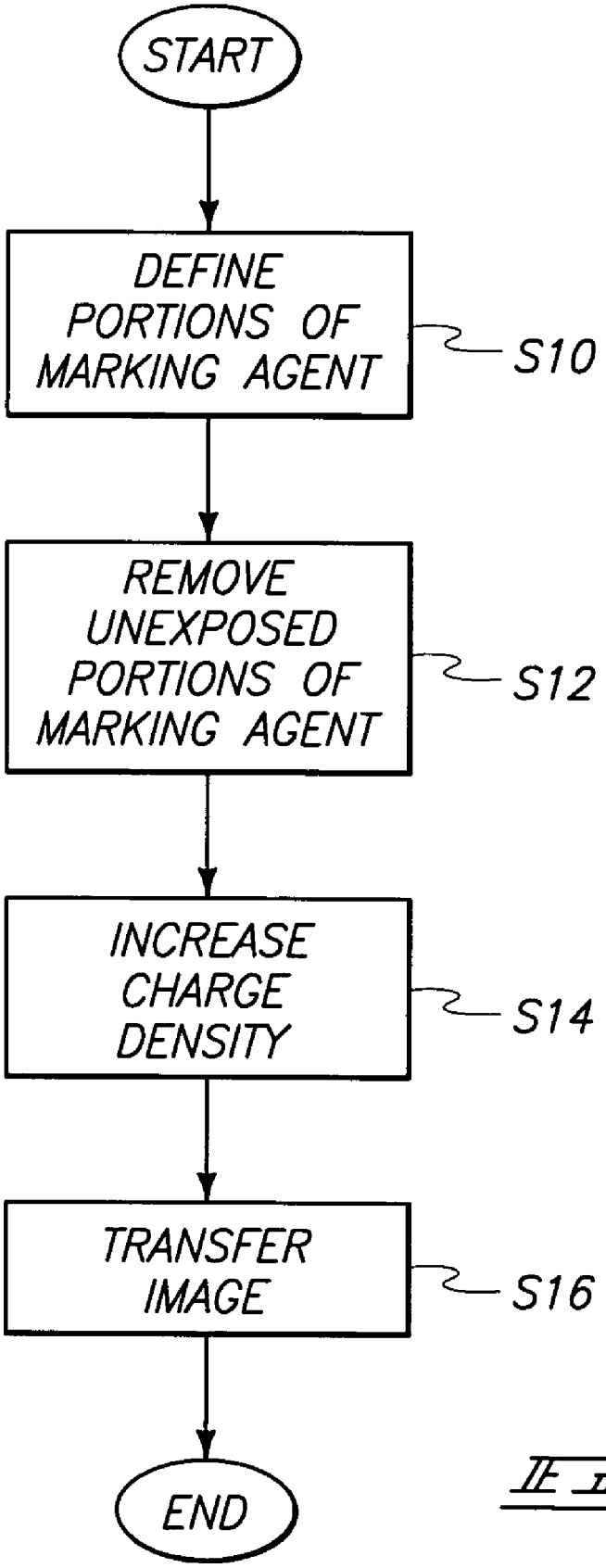
FIG. 3 is a flow chart of an imaging method according to one embodiment.

Referring to FIG. 3, a flow chart depicts an exemplary imaging method according to one embodiment. Other methods are possible including more, less or alternative steps.

At a step S10, some portions of a layer of marking agent (e.g., upon a support surface of an imaging member in one configuration) are exposed to an electrical charge corresponding to areas of an image to be formed. In one example, an electrical charge is applied to expose portions of the marking agent corresponding to the image. The applied electrical charge operates to stiffen the selected portions of the marking agent. Background portions of the marking agent are not electrically charged in the described embodiment. Step S10 operates to form a latent image in the described example.

At a step S12, the latent image defined by step S10 is developed. In one development example, unexposed portions of the marking agent not receiving the electrical charge of step S10 and corresponding to background areas of the image are removed from the exposed portions of the marking agent. In one method, a development fluid is used to remove the unexposed portions of the marking agent and the development fluid is thereafter also removed from the exposed portions of the marking agent corresponding to the developed image.

At a step S14, the charge density of the exposed portions of the marking agent is increased. An electrical charge is applied to the stiffened portions of the marking agent remaining after step S12. The electrical charge of step S14 clamps the stiffened portions of the marking agent to a support surface for additional processing including, for example, removal of development fluid which remains upon the support surface after the processing of step S12 and image transfer described below.

At a step S16, the stiffened portions of the marking agent corresponding to the image may be transferred from the support surface. In one embodiment, electrostatic transfer is used to attract the image from the support surface to media, a transfer roller, or other imaging member of imaging device 1.

Utilization of charge device 18 to provide a subsequent electrical charge to the marking agent after the use of an initial electrical charge to expose desired portions of the marking agent is believed to increase the printing speed of imaging device 1. Furthermore, clamping of developed images to a support surface according to one embodiment enables the use of some imaging techniques described above which may otherwise distort or smear developed images. For example, development fluid removal techniques having relatively high shear stresses may be used to achieve increased fluid removal rates without image degradation. Furthermore, clamping enables developed images to sustain relatively high shear transfer stresses within a transfer nip without distortion. The clamping of developed images enables the use of relatively rapid techniques for removing development fluid from the support surface providing increased imaging speeds. As mentioned previously, transfer efficiency of clamped images may be enhanced if electrostatic image transfer techniques are used. Usage of an electrically conductive imaging substrate in one embodiment enables the use of increased charging levels while reducing or avoiding breakdown problems associated with other substrates, including for example photoconductive substrates.

In one test using a developed 400 micron dot, the application of a pretransfer charge of −85 $nC/cm^2$ enhanced and preserved the integrity and density of the dot during the exemplary processing discussed above including development fluid removal and transfer from the support surface.

The exemplary aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure.

The protection sought is not to be limited to the disclosed embodiments, which are given by way of example only, but instead is to be limited only by the scope of the appended claims.

What is claimed is:

1. An imaging method comprising:

defining a plurality of first portions of a layer of a marking agent corresponding to an image to be formed;

using a development fluid, removing second portions of the layer of the marking agent after the defining;

increasing a charge density of the first portions of the layer of the marking agent after the removing;

transferring the first portions of the layer of the marking agent after the increasing; and removing the development fluid after the increasing and before the transferring.

2. The method of claim 1 wherein the defining comprises defining the first portions of the layer of the marking agent upon an electrically conductive support surface of an imaging member.

3. The method of claim 1 further comprising providing the layer of the marking agent over an imaging member, and the increasing increases an electrostatic force of the first portions of the marking agent relative to the imaging member.

4. The method of claim 3 wherein the defining comprises applying an electrical charge to the first portions of the layer of the marking agent providing an electrostatic force of the first portions of the layer of the marking agent relative to an electrically conductive surface of the imaging member supporting the layer of the marking agent, and the increasing comprises increasing the electrostatic force.

5. The method of claim 1 wherein the transferring comprises transferring using an electrical field.

6. The method of claim 1 wherein the defining comprises applying a first electrical charge to the first portions of the layer of the marking agent, and the increasing comprises applying a second electrical charge to the first portions of the layer of the marking agent.

7. The method of claim 6 wherein the first and second electrical charges are electrical charges having a common electrical polarity.

8. The method of claim 1 wherein the removing the development fluid comprises removing one portion of the development fluid, and further comprising removing another portion of the development fluid before the increasing.

9. An imaging method comprising:

defining some portions of marking agent upon an imaging member corresponding to an image, the defining creating an attraction force of the some portions of the marking agent relative to the imaging member;

after the defining, increasing the attraction force of the some portions of the marking agent relative to the imaging member;

transferring the some portions of the marking agent from the imaging member after the increasing; and removing other portions of the marking agent using a development fluid after the defining and before the increasing; and removing the development fluid from the imaging member after the increasing and before the transferring.

10. The method of claim 9 wherein the increasing comprises increasing using an electrical charge.

11. The method of claim 9 wherein the defining comprises defining the some portions of the marking agent upon an electrically conductive surface of the imaging member.

12. The method of claim 9 further comprising removing a portion of the development fluid before the increasing.

13. The method of claim 9 further comprising removing other portions of the marking agent from the imaging member, and wherein the increasing comprises increasing after the removing the other portions.

14. The method of claim 9 wherein the defining comprises applying a first electrical charge to the some portions of the marking agent, and the increasing comprises applying a second electrical charge to the some portions of the layer.

15. The method of claim 14 wherein the first and second electrical charges are electrical charges having a common electrical polarity.

16. An imaging device comprising:

a supply device configured to supply a marking agent to be used to form hard images;

an imaging member configured to support the marking agent;

an image head configured to define a plurality of first portions of the marking agent corresponding to an image to be formed;

a development assembly configured to use a development fluid to remove second portions of the marking agent from the imaging member;

a charge device configured to provide an electrical charge to the first portions of the marking agent after the removal of the second portions of the marking agent and prior to transfer of the first portions of the marking agent from the image member; and a removal device configured to remove a portion of the development fluid from the imaging member after the charge device has provided the electrical charge and prior to the transfer of the first portions of the marking agent from the imaging member.

17. The device of claim 16 wherein the development assembly is configured to remove another portion of the development fluid from the imaging member before the provision of the electrical charge by the charge device.

18. The device of claim 16 wherein the image head is configured to electrically charge the first portions of the marking agent to define the first portions of the marking agent.

19. The device of claim 18 wherein an electrostatic force intermediate the first portions of the marking agent and the imaging member is generated by the electrical charge by the image head, and wherein the electrical charge provided by the charge device increases the electrostatic force.

20. The device of claim 16 wherein the image head is configured to provide another electrical charge to the first portions of the marking agent to define the first portions of the marking agent, and the electrical charges from the image head and the charge device have a common electrical polarity.

21. An imaging device comprising:

an image head configured to define a plurality of portions of a layer of a liquid marking agent upon an imaging member, wherein the defined portions of the marking agent correspond to an image and have an increased viscosity compared with other portions of the marking agent;

a first removal device configured to use a development fluid to remove the other portions of the marking agent from the defined portions of the marking agent;

a charge device configured to increase a charge density of the defined portions of the marking agent after the removal of the other portions of the marking agent; and a second removal device configured to remove at least some of the development fluid from the imaging member after the increasing of the charge density by the charge device and prior to transfer of the defined portions of the marking agent.

22. An imaging device comprising:

image means for creating an electrostatic force intermediate some portions of a marking agent and support means supporting the marking agent for defining an image comprising the some portions of the marking agent;

first removal means for using a development fluid to remove other portions of the marking agent from the support means;

charge means for increasing the electrostatic force after the defining of the image;

transfer means for transferring the some portions of the marking agent corresponding to the image after the increasing the electrostatic force; and second removal means for removing at least some of the development fluid from the support means after the increasing and before the transferring.

* * * * *